United States Patent [19]

Greenwood

[11] Patent Number: 4,696,215

[45] Date of Patent: Sep. 29, 1987

[54] MANUALLY CONTROLLED PERFORMANCE APPARATUS FOR ELECTRONIC MUSICAL INSTRUMENT

[75] Inventor: Walter L. Greenwood, Alburtis, Pa.

[73] Assignee: Allen Organ Company, Macungie, Pa.

[21] Appl. No.: 779,764

[22] Filed: Sep. 24, 1985

[51] Int. Cl.[4] ..... G10F 1/00; G10H 7/00

[52] U.S. Cl. ..... 84/1.03; 84/128; 84/115

[58] Field of Search ..... 84/1.03, 1.01, 1.28, 84/115, DIG. 12, 1.19, 1.24

[56] References Cited

U.S. PATENT DOCUMENTS

| | | | |
|---|---|---|---|
| 3,868,882 | 3/1975 | Fukui et al. | 84/462 |
| 3,878,750 | 4/1975 | Kapps | 84/1.01 |
| 3,890,871 | 6/1975 | Oberheim | 84/1.01 |
| 3,955,459 | 4/1976 | Mochida et al. | 84/1.01 |
| 4,160,399 | 7/1979 | Deutsch | 84/1.03 |
| 4,345,501 | 8/1982 | Nakada et al. | 84/1.03 |
| 4,387,620 | 6/1983 | Okamoto et al. | 84/1.03 |
| 4,402,244 | 9/1983 | Nakada et al. | 84/1.03 |
| 4,417,494 | 11/1983 | Nakada et al. | 84/1.03 |
| 4,432,266 | 2/1984 | Nakada | 84/1.03 |
| 4,466,324 | 8/1984 | Okamoto et al. | 84/1.03 |
| 4,476,766 | 10/1984 | Ishii | 84/1.03 |
| 4,522,100 | 6/1985 | Ishii | 84/1.03 |

OTHER PUBLICATIONS

TI Learning Catre. "Understanding Solid-State Electronics" 1972, p. 209.

*Primary Examiner*—Arthur T. Grimley
*Assistant Examiner*—David S. Warren
*Attorney, Agent, or Firm*—Seidel, Gonda, Goldhammer & Abbott

[57] ABSTRACT

An automatic playing device for a musical instrument includes a memory unit which stores a plurality of discrete states, e.g., patterns of key actuation of a keyboard, which can be serialized and combined with or substituted for manual keying information from a keyboard or other control device. Combining and substituting are controlled by the actuation of one or more switches by a human operator. The operator can advance through the stored pattern by actuating a single key or by playing a simple sequence of notes on a keyboard.

10 Claims, 5 Drawing Figures

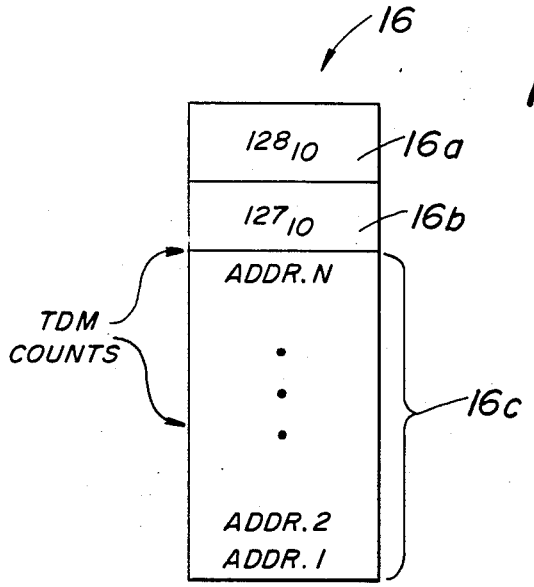
FIG. 3
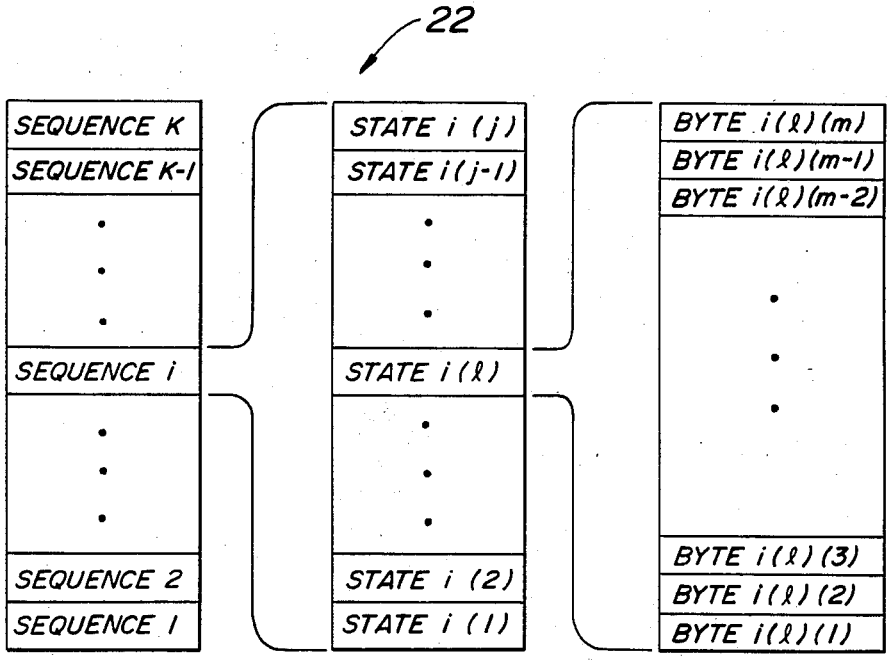

FIG. 4

| | 1 | 2 | 3 | | 4 | 5 | 6 | |
|---|---|---|---|---|---|---|---|---|
| | CC#DD#EFF#G | G#AA#BCC#DD# | EFF#GG#AA#B | CC#DD#EFF#G | G#AA#BCC#DD# | EFF#GG#AA#B | CC#DD#EFF#G | G#AA#BC |
| | GREAT 0 | 1 | 2 | 3 | 4 | 5 | 6 | 7 |
| | PEDAL 8 | 9 | A | B | C | D | E | F |
| 0 | | | 00010010 | 00010000 | | | | |
| | | 00000001 | | | | | | |
| 1 | | | 00010000 | 10010000 | | | | |
| | | 00001000 | | | | | | |
| 2 | | | 00000010 | 00100100 | | | | |
| | | 00100000 | | | | | | |
| 3 | | | 00000010 | 00010001 | | | | |
| | | 00000001 | | | | | | |
| 4 | | | | 10010000 | 1000 0000 | | | |
| | | 10000000 | | | | | | |
| 5 | | | 00000010 | 00010001 | | | | |
| | | 00100000 | | | | | | |
| 6 | | | 00010000 | 00010000 | | | | |
| | | 00100000 | | | | | | |
| 7 | | | 01000010 | 00010000 | | | | |
| | | 00100000 | | | | | | |
| 8 | | | 01000010 | 00100000 | | | | |
| | | 00100000 | | | | | | |
| 9 | | | 00010010 | 00010000 | | | | |
| | | 00000001 | | | | | | |

MANUALLY CONTROLLED PERFORMANCE APPARATUS FOR ELECTRONIC MUSICAL INSTRUMENT

BACKGROUND OF THE INVENTION

This invention relates to electronic musical instruments using multiplexed keying information, and to automatic playing devices for such instruments.

An object of the invention is to eliminate the "mechanical" nature of the musical effects generated by an automatic playing device by introducing an extra measure of direct human control over the operation of the device in the time domain, thus placing ryhthm and phrasing directly under human control, and making an accompaniment generated by such a device better adaptable to the behavior of soloists, choirs, congregations or other accompanied groups of musicians. The invention can be used for accompaniment of a choir or church congregation in the absence of a competent organist, or could be incorporated into the auto-play features on an electronic organ or synthesizer intended for home or entertainment use.

Advantages which the invention offers over conventional auto-play mechanisms include its relative simplicity and the retention of direct human control over rythm and tempo.

Automatic playing devices with tempo control are known. U.S. Pat. No. 3,890,871, for example, discloses a sequencing apparatus for storing melodic and rythmic information responsive to electric signals produced by playing an electronic instrument keyboard. The sequencer develops digital codes representing the durations between successive notes, and in addition converts the analog signals representing the pitch of a note into digital form. Upon command, the digital pitch information is reconverted to analog form and returned to the electronic instrument at a selectable speed above or below the tempo of the melody originally played on the synthesizer keyboard. Thus, the tempo of melody playback can be made faster or slower than the tempo of the original melody.

U.S. Pat. No. 4,345,501 discloses a tempo control device for automatic performance where the tempo of the automatic accompaniment is speeded up or slowed down to follow that of manual melody performance as the tempo of the manual performance changes during the performance. The invention disclosed in this patent permits automatic accompaniment to follow the tempo of manual melody play.

U.S. Pat. No. 4,476,766 discloses an electronic musical instrument which generates accompaniment and melody sounds with different tone colors. Predetermined performance keys in a group for a low octave section are used as read-out keys for reading out accompaniment memorized in a first memory, and the other keys in the keyboard are used as read-out keys for reading out melody memorized in a second memory. There is no mention in this patent of tempo control in what is recorded and no mention of playback tempo control other than that which results from random key depressions.

There is a need for a device which provides for automatic playback of both melody and accompaniment while also providing retention of direct human control over playback rythm and tempo. This invention meets that need.

SUMMARY OF THE INVENTION

The present invention is an electronic keyboard instrument comprising a first memory means for storing a plurality of predetermined sequences of digital words, each sequence being representative of a sequence of musical notes, second memory means for storing a predetermined set of instructions for recalling a selected sequence from the first memory in response to operator actuation of a key on the keyboard, and selector means for selecting among the recalled sequence of notes, notes played on the keyboard, and a combination of both the recalled sequence of notes and the notes played on the keyboard.

The first memory means holds a number of discrete states or patterns of keying information which can be serialized and spliced into or substituted for the keying information from the keyboards or other control device. Splicing or substitution, and the transition from one state for a pattern of keying information to the next, are controlled directly by actuation of one or more switches by the human operator. For example, if the device were installed in a church organ, a person with no keyboard training, but with some musical awareness and sense of rhythm, could act as a substitute organist by guiding the organ through a pre-programmed sequence of musical sounds which, taken together, would constitute a hymn or accompaniment for a choral work. The operator would advance through the musical sequence by actuating a single key or pushbutton or other switch, or by playing a simple scale pattern on a keyboard.

DESCRIPTION OF THE DRAWINGS

For the purposes of illustrating the invention, there is shown in the drawings a form which is presently preferred; it being understood, however, that this invention is not limited to the precise arrangements and instrumentalities shown.

FIG. 3 depicts the organization of the mapping memory and sequence memory of the invention in simplified form.

FIG. 4 is a coding chart in hexadecimal and binary notation illustrating the operation of the sequence memory of the present invention.

DESCRIPTION OF THE INVENTION

Figure 1:
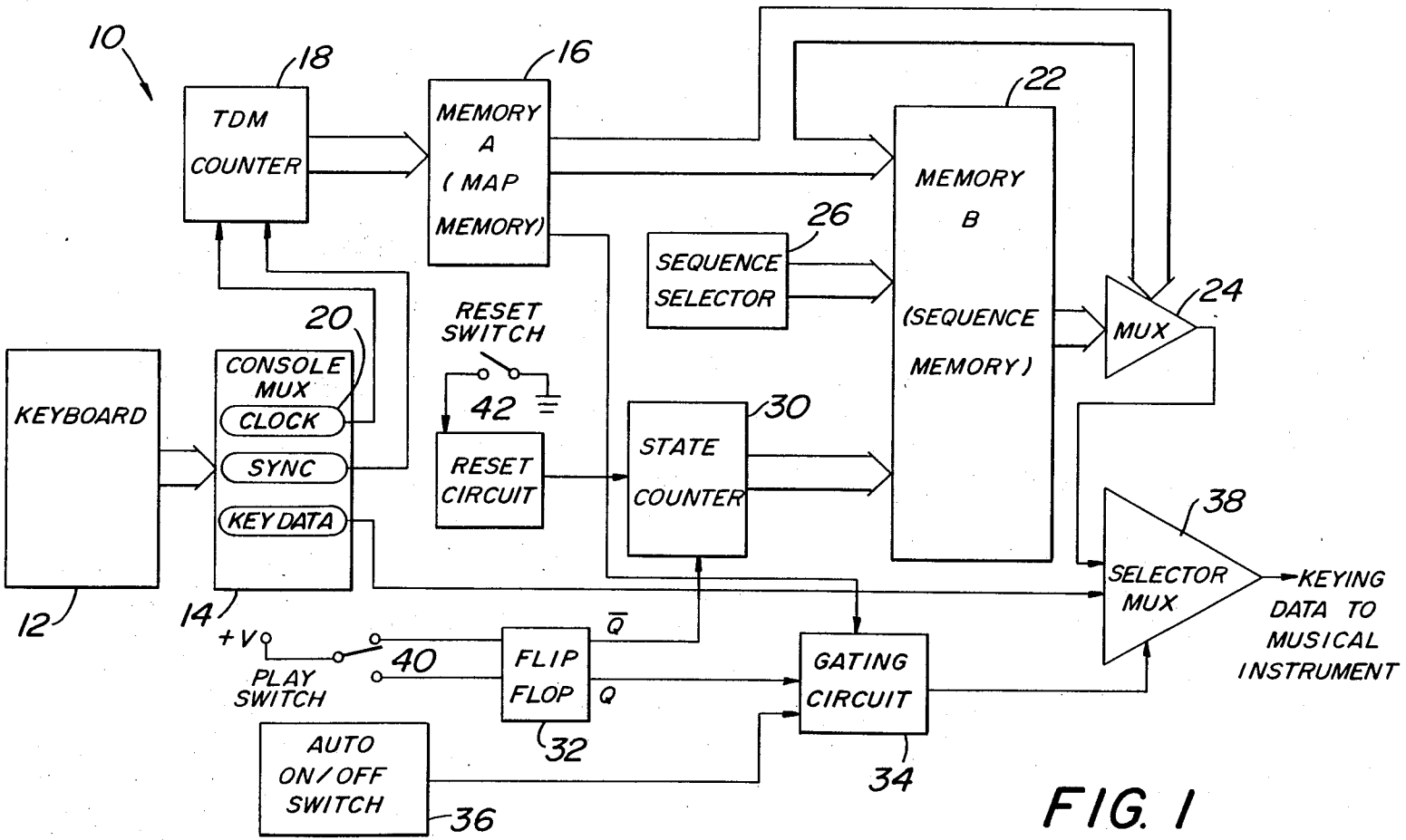
FIG. 1 is a block diagram illustrating the major functional blocks of one embodiment of the invention, in simplified form.

Referring now to the drawings, wherein like numerals indicate like elements, there is shown in FIG. 1 a simplified block diagram of the invention 10. A keyboard 12 is time division multiplexed (TDM) by a console multiplexer 14 in synchronism with a map memory 16 controlled by a counter 18. Multiplexer 14 and counter 18 are synchronized by multiplexer clock 20. Map memory 16 maps the count sequence presented at its address inputs into a sequence of addresses designed to access a certain sequence of bytes of data from sequence memory 22 and time division multiplex the individual bits of those data bytes via multiplexer 24. Map memory 16 and sequence memory 22 may be a read-only memory (ROM), a programmable read-only memory (PROM) or a random access memory (RAM). A sequence selector 26 selects an area of sequence memory 22 containing a desired sequence of musical note combinations. Sequence selector 26 provides an address for a block of sequence memory 22 which contains data for a particular musical selection, comprising a sequence of serial bit streams to be spliced into the key data stream from the console multiplexer 14.

Console multiplexer 14 produces keyboard data in serial form. For a more complete description of how console multiplexer 14 operates, reference may be made to U.S. Pat. No. 3,639,913, which is incorporated herein by reference. For purposes of this disclosure, it is sufficient to note generally that keyboard 12 is scanned repeatedly at a high rate, and each scan cycle is divided into a number of time slots, one time slot for each key of keyboard 12. Each key is scanned in sequence during one TDM cycle.

TDM counter 18 runs in synchronism with clock 20 in console multiplexer 14, producing one unique count for each of 512 intervals in the scan cycle. The scan cycle is divided into four parts of 128 counts each, corresponding to the four divisions of a typical organ having three manuals and pedals. Each of these four parts contains serial data representing the states of the keys of the corresponding division. The count sequence from the TDM counter 18 addresses map memory 16 which gives as its output addresses of single bits of information (stored in some area of sequence memory 22) which are to appear at the output of the selector multiplexer 38 in synchronism with the TDM count sequence.

Automatic play is accomplished by means of the PLAY switch 40 and AUTO ON/OFF switch 36. AUTO ON/OFF switch 36 is placed in the ON mode. When the user activates the PLAY switch 40, a gating signal is applied via flip-flop 32 to an AND gate in gating circuit 34 to allow the sequence of serial bit streams from sequence memory 22 to be passed to selector multiplexer 38. During the time the play switch 40 is depressed, map memory 16 maps the TDM count into a series of address to pick successive bits out of sequence memory 22 and place them, one at a time, into selector multiplexer 38. When the play switch 40 is released, flip-flop 32 changes state and clocks the state counter 30 into its next state, so that the next activation of the switch will access the next "chord" stored in sequence memory 22. The state number can be reset to 0 at any time by closing reset switch 42. (The state number may be automatically reset when the unit is powered up.)

If AUTO ON/OFF switch 36 is in the OFF mode, console key data is unconditionally passed through selector multiplexer 38 to the output, thus putting the instrument in the manual playing mode.

Figure 2:
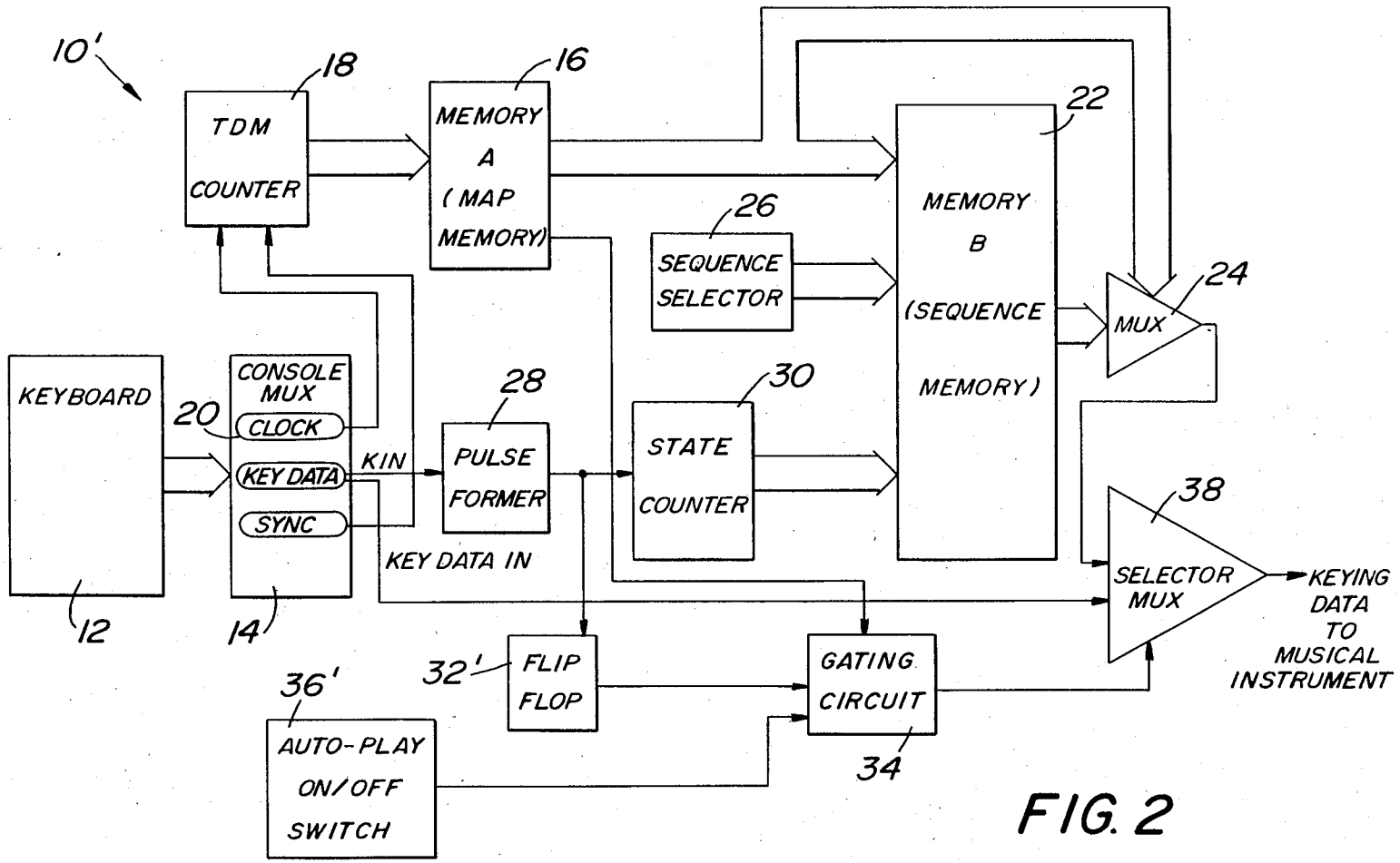
FIG. 2 is a block diagram illustrating the major functional blocks of a second embodiment of the invention, in simplified form.

A second embodiment of the invention is illustrated in FIG. 2. In this embodiment, the function of play switch 40 is performed by a pulse former circuit 28 which detects changes in a serial data stream resulting from the depression and release on keys on one of the organ's keyboards. In this embodiment, pulse former 28 is driven by the "K IN" signal from console multiplexer 14, which consists of only one of the four 128-bit sections of the full 512-bit key scanning TDM cycle. This section thus corresponds to only one of the divisions, or keyboards, of the musical instrument. The console multiplexer output labeled "KEY DATA IN" consists of the entire 512-bit data stream, and corresponds to the sum of all four divisions. K IN is used only to trigger state counter 30 in the auto play mode, and the KEY DATA IN signal is simply passed through selector multiplexer 38 in the absence of auto play data.

Changes in the keyboard data from one TDM cycle to the next, for example by depressing or releasing different keys, are detected by pulse former 28, which produces a pulse when a change is detected. This pulse clocks a state counter 30 and flip flop 32. State counter 30 advances sequence memory 22 through the sequence selected by sequence selector 26 and sends a gating bit to gating circuit 34. State counter 30 provides an address for a particular part of the musical selection selected by the sequence selector 26, corresponding to a single "chord" or state of the keyboard scan cycle. This state incorporates the up or down condition for every key in a given keyboard.

Flip flop 32 represents to gating circuit 34 the fact that the key or switch being actuated by the operator is up or down. Gating circuit 34 also receives information from on/off switch 36 which selects automatic playing ("autoplay") or normal playing mode.

The operation of an electronic organ equipped with the apparatus of the first embodiment of the present invention can be briefly summarized as follows.

The operator selects the desired registration or stop combination (in known manner and independently of the present invention), and then places the organ in the autoplay mode by means of AUTO ON/OFF switch 36. The operator then selects the desired musical sequence by means of the sequence selector 26 and activates the reset switch 42 to reset the state counter 30. When the operator presses the play switch 40, the organ will sound the first chord of the musical sequence until the switch is released. When the operator again presses the switch, the second chord will sound until the switch is released. The action continues thus until the musical selection is finished. The operator may at any time return to the beginning of the selection by activating the reset switch, or change musical selections by changing the setting of the sequence selector 26. Rhythm and phrasing are controlled by the operator directly through pressing and releasing the play switch 40. The operator may deactivate the auto-play feature of the invention and place the organ in the manual play mode by placing AUTO ON/OFF switch to the OFF position. The organ may then be played in the conventional manner.

Operation of the second embodiment of the invention is quite similar. A particular sequence in sequence memory 22 is selected by the operator by means of sequence selector 26. After the operator has selected the desired sequence, individual states of that sequence are recalled by depressing a key on keyboard 12. When a key is depressed for the first time, the first state is recalled for playback. Subsequent states, however, are not recalled until the. pulse former 28 detects a change in keyboard state, i.e., until the key is released and depressed a second time, or until a different key is pressed. This change in the keyboard state is detected by the pulse former, which clocks the state counter and causes it to address sequence memory 22 so as to call the next state in the selected sequence. Individual bytes in each state are clocked out in sequence under control of mapping memory 16 in response to clocking inputs from TDM counter 18.

By controlling when the keyboard state changes, that is, by deciding when to depress and release keys, the operator has direct control over the rhythm between recalled states, i.e., the operator has direct control over rhythm and phrasing.

The arrangement of mapping memory 16 and sequence memory 22 is the same for both embodiments of the invention and is illustrated in simplified form in FIG. 3. Mapping memory 16 contains data designed to either (1) disable normal keying and enable auto-play data;
(2) disable both normal keying and auto-play data; or
(3) disable auto-play data and enable normal keying data.

As illustrated in simplified form in FIG. 3, memory location 16*a* contains the address to be applied to multiplexer 24 for any and all TDM counts for which the auto-play feature is to disabled and normal keying data is to be enabled. Memory location 16*b* provides a different address to multiplexer 24 for any and all TDM counts for which both auto-play data and normal keying data are to be disabled. Memory locations 16*c* contain desired addresses to be applied to sequence memory 22 for all TDM counts which are to cause auto-play data to be recalled from sequence memory 22.

As also shown in FIG. 3, sequence memory 22 is divided into a plurality of sequences, namely k sequences for the illustrated embodiments. Each sequence contains a desired pattern of musical note combinations.

For example, assume that TDM slot $\mathbf{408}_{10}$ is associated with note $C_1$ in the pedal division of an organ equipped with the auto-play device of the present invention. (The designation "$\mathbf{408}_{10}$" is conventional decimal notation and will be understood by anyone skilled in the art.) When the TDM counter reaches $\mathbf{408}_{10}$, that location in map memory 16 is addressed. If the most significant bit (MSB) of the byte at that address location is a "1", console data will be gated through in lieu of auto-play data, and the output of the selector multiplexer 38 during that time slot will be "1" if and only if the $C_1$ key in the pedal division is depressed. If, however, the MSB of the byte at location $\mathbf{408}_{10}$ in map memory 16 is a "0", console data is not gated through. In this case the lower seven bits of byte $\mathbf{408}_{10}$ are used to access a single bit in sequence memory 22. The highest four bits out of these seven address a specific byte within the block of sequence memory 22 determined by the sequence number and state address, and the lowest three bits pick out a single bit from that byte, via multiplexer 24. The selected bit is passed to the output via selector multiplexer 38 by virtue of the "0" state of the MSB. This bit will indicate to the musical instrument that $C_1$ in the pedal division is to be on ("1") or off ("0"). If the MSB out of map memory 16 is equal to "1" and/or the AUTO ON/OFF switch is OFF, sequence memory 22 will still be accessed, but its output will not influence the output at selector multiplexer 38.

The four-bit sequence address picks one of sixteen blocks in sequence memory 22 corresponding to the desired musical selection. The seven-bit state address picks one of 128 states or "chords" which together constitute a sequence or musical selection. It is understood that the distribution of address lines and their functions and the organization of the data within sequence memory 22 could be changed without altering the invention. For example, increasing the sequence address to five bits and decreasing the state address to six bits would yield twice as many musical selections, but each with half as many states available for use. Likewise, a 512K bit EPROM could be used, and the extra address line assigned to either the state address, sequence address, or note address.

In general, if sequence memory 22 contains k sequences of j states each, and each state contains m digital words of n bits each, then:

(1) sequence address must consist of $\log_2(k)$ bits;
(2) state address must consist of $\log_2(j)$ bits; and
(3) note address must consist of $\log_2(m)$ plus $\log_2(n)$ bits, and $\log_2(m)$ bits of note address drive the address inputs of sequence memory 22 while $\log_2(n)$ bits of note address drive the select inputs of multiplexer 24.

It should be noted that although the state address assumes 128 unique values, any given musical sequence need not utilize all 128 states which are available in sequence memory 22. A selection having fewer than 128 chords will be stored in the part of sequence memory 22 memory space having lower-valued addresses, and the balance of the memory locations within the sequence will contain null values ("0").

Divisions of the organ which are represented by portions of the TDM scan cycle which address areas of map memory 16 in which MSBs are set equal to "1" (i.e., containing $\mathbf{80}_{16}$ or greater, up to $FF_{16}$) remain in normal manual play mode even while the auto-play device is operated. For example, TDM counts $\mathbf{0}_{10}$ through $\mathbf{127}_{10}$ might represent the Swell division of an organ. In map memory 16, these addresses hold the value $\mathbf{80}_{16}$ which results in a "1" gating bit being sent to gating circuit 34 during this portion of the scan cycle, thus passing console data through for the Swell division. As a result, the operator could, in this case, play normally on the Swell keyboard while simultaneously operating the Great and Pedal divisions via the autoplay function. This feature may be made programmable via data held in map memory 16.

To further clarify the operation of sequence memory 22, reference may be made to FIG. 4, which shows the bit-level coding of the first line of the hymn "God Of Our Fathers". The coding chart shows ten states of sixteen bytes each, in binary notation, stored in the first ten state locations of some sequence block in sequence memory 22. The numbers in the column on the extreme left give the state address values. The hexadecimal numbers 0 through 7 and 8 through F across the top of the chart give the higher four bits of the note address values. Each combination of a state address and four high bits of the note address yields a single byte. Individual bits from that byte are scanned by the lower three bits from the note address. The correspondence between bit locations and musical notes is shown by the notes of the chromatic scale written across the top horizontal axis of the chart. For each sixteen byte "state", the first eight bytes (0 through 7) give data for the Great division of an organ, and the second 8 bytes (8 through F) give data for the Pedal division. This distribution can be changed by appropriate programming of the map memory 16. In the chart, a "0" indicates note off; "1" indicates note on; and all bytes not filled in contain "0" values.

Figure 5:
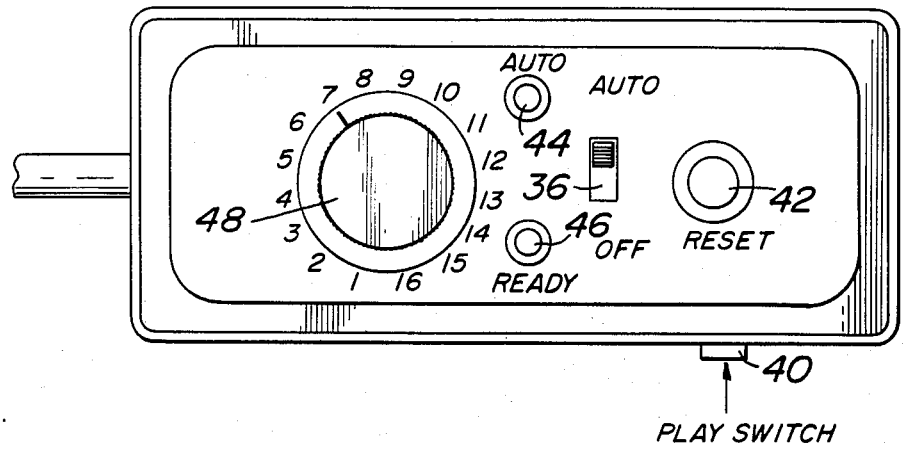
FIG. 5 illustrates a control box in which the present invention may be housed and which has operator-accessible controls mounted thereon.

The present invention may be readily packaged in a control box such as that shown in FIG. 5. The control box may be coupled to the musical instrument by means of a cable. The control box supports the operator-accessible controls, such as AUTO ON/OFF switch 36, PLAY switch 40, RESET switch 42 and sequence selector knob 48. AUTO indicator light 44 to indicate when the invention is in the autoplay mode and READY light 46 are also provided to give the operator visual indication of the status of the auto-play device of the invention.

The present invention may be embodied in other specific forms without departing from the spirit or essential attributes thereof and, accordingly, reference should be made to the appended claims, rather than to the foreging specification, as indicating the scope of the invention.

I claim:

1. An electronic musical instrument comprising:
(a) manually actuated control means for generating operator-derived control data,
(b) at least two keyboards,
(c) time-division multiplexing means for encoding key actuations of the keyboards into time-division multiplexed keyboard-notes data signals,
(d) memory means for storing note data representative of predetermined combinations of musical notes,
(e) preprogrammed addressing means synchronous with the time-division multiplexing means for generating mode control data representative of predetermined operating modes for each of the keyboards and address data for addressing the note data stored in the memory means,
(f) counter means responsive to the operator-derived control data for enabling the memory means to recall therefrom time-division multiplexed stored-notes data signals representative of the predetermined combinations of musical notes associated with respective counts of the counter means,
(g) selector means for selecting between the keyboard-notes data signals for keyboards in a first operating mode and the stored-notes data signals for keyboards in a second operating mode and forming a composite-notes data signal,
(h) selector control means responsive to the operator-derived control data and the mode control data for controlling the selector means, and
(i) means responsive to the composite-notes data signal for producing the sounds of the instrument corresponding to the notes encoded in the composite-notes data signal.

2. An electronic musical instrument as in claim 1, wherein the manually actuated control means generates control data representative of either a manual play mode or a programmed-play mode.

3. An electronic musical instrument as in claim 1, wherein the manually actuated control means is remotely coupled to the instrument.

4. An electronic musical instrument as in claim 1, wherein the addressing means comprises second memory means for storing preprogrammed mode control data and synchronizing means for synchronizing the readout of the second memory means with the time-division multiplexed keyboard-notes data signals.

5. An electronic musical instrument as in claim 4, wherein the synchronizing means comprises a counter for synchronously counting the time divisions of the time-division multiplexed keyboard-notes data signals.

6. Apparatus for electronically controlling a musical instrument having plural keyboards, comprising:
(a) manually actuated control means for generating operator-derived control data,
(b) means for sensing actuation of the keys on each keyboard,
(c) time-division multiplexing means for encoding key actuations of the keyboards into time-division multiplexed keyboard-notes data signals,
(d) memory means for storing note data representative of predetermined combinations of musical notes,
(e) preprogrammed addressing means synchronous with the time-division multiplexing means for generating mode control data representative of predetermined operating modes for each of the keyboards and address data for addressing the note data stored in the memory means,
(f) counter means responsive to the operator-derived control data for enabling the memory means to recall therefrom time-division multiplexed stored-notes data signals representative of the predetermined combinations of musical notes associated with respective counts of the counter means,
(g) selector means for selecting between the keyboard-notes data signals for keyboards in a first operating mode and the stored-notes data signals for keyboards in a second operating mode and forming a composite-notes data signal, and
(h) selector cotrol means responsive to the operator-derived control data and the mode control data for controlling the selector means.

7. Apparatus as in claim 6, wherein the manually actuated control means generates control data representative of either a manual play mode or a programmed-play mode.

8. Apparatus as in claim 6, wherein the apparatus is remotely coupled to the instrument.

9. Apparatus as in claim 6, wherein the addressing means comprises second memory means for storing preprogrammed mode control data and synchronizing means for synchronizing the readout of the second memory means with the time-division multiplexed keyboard-notes data signals.

10. Apparatus as in claim 9, wherein the synchronizing means comprises a counter for synchronously counting the time divisions of the time-division multiplexed keyboard-notes data signals.

* * * * *